United States Patent [19]

Barnicol-Ottler et al.

[11] Patent Number: 4,654,476

[45] Date of Patent: Mar. 31, 1987

[54] FLEXIBLE MULTICONDUCTOR ELECTRIC CABLE

[75] Inventors: Max Barnicol-Ottler; Martin Loczenski, both of Neustadt; Norbert Mieschke, Coburg; Gerhard Ott; Gerhard Przybylski, both of Neustadt; Erich Puff; Dietmar Weber, both of Coburg, all of Fed. Rep. of Germany

[73] Assignee: Siemens Aktiengesellschaft, Berlin and Munich, Fed. Rep. of Germany

[21] Appl. No.: 701,021

[22] Filed: Feb. 12, 1985

[30] Foreign Application Priority Data

Feb. 15, 1984 [DE] Fed. Rep. of Germany ..... 3405852

[51] Int. Cl.[4] ..... H01B 11/02

[52] U.S. Cl. ..... 174/116; 174/27; 174/113 R; 174/113 C

[58] Field of Search ..... 174/27, 113 R, 113 C, 174/116, 131 R

[56] References Cited

U.S. PATENT DOCUMENTS

| | | | |
|---|---|---|---|
| 2,544,503 | 3/1951 | Kennedy | 174/116 |
| 2,718,544 | 9/1955 | Shepp | 174/113 R |
| 3,699,238 | 10/1972 | Hansen et al. | 174/115 |

FOREIGN PATENT DOCUMENTS

| | | |
|---|---|---|
| 389047 | 6/1965 | Fed. Rep. of Germany . |
| 1465777 | 7/1971 | Fed. Rep. of Germany . |
| 2504555 | 8/1976 | Fed. Rep. of Germany . |
| 3151234 | 6/1983 | Fed. Rep. of Germany . |
| 2447081 | 1/1978 | France . |

*Primary Examiner*—Arthur T. Grimley
*Assistant Examiner*—Morris H. Nimmo
*Attorney, Agent, or Firm*—Kenyon & Kenyon

[57] ABSTRACT

To improve the mechanical strength of a rubber hose cable, support elements are arranged between the conductors and the support elements are connected to a high tensile strength wrapping applied with a lay opposite the twisted conductors with adhesion or by cementing.

20 Claims, 4 Drawing Figures

FLEXIBLE MULTICONDUCTOR ELECTRIC CABLE

BACKGROUND OF THE INVENTION

This invention relates to the field of electric power transmission and more particularly to flexibly coupling a transportable consumer to a stationary power network, using an electric multiconductor cable.

Flexible electric cables which are used for the control and/or power supply of transportable consumers such as lifting devices, transporting and conveyer installations, and which are continuously wound on and unwound from a drum, are subjected to considerable mechanical stresses. Sometimes, these stresses lead to corkscrew-like dislocations of a cable. In itself, the design of such a cable which consists in the usual manner of insulated conductors twisted with each other or about a core (dummy conductor or supporting member) and of a one or two layer jacket, which is optionally provided with an embedded braid and, sometimes, a filling of the corners between the insulated conductors, which takes the occurring mechanical stresses into account is known. (DE-OS No. 25 04 555). Even with the disclosed design, mechanical stresses can result from torsional and tensile stresses of the insulated conductors in conjunction with their mobility relative to each other as well as relative to the jacket, which result in the mentioned dislocations.

For controlling the internal stresses in a cable that can be wound on a drum, a design is known, in which each insulated conductor is surrounded by a hose-like, extruded synthetic material layer with the interposition of a release agent layer containing a lubricant, and in which this hose layer is connected with material contact to the core and/or the jacket. In such a cable, the core, the hose-like plastic layer of the insulated conductors and the inner jacket form an elastic, flexible corset, in which the insulated conductors can move independently of each other with a sliding motion. Because of the material locking connection of several design elements which are distributed over the cross section, the flexibility of the cable as a whole is impeded (DE-OS No. 31 51 234).

For the power supply of mining equipment, a cable, in which, in the corner spaces of the mutually twisted insulated conductors, the ground conductor, as well as corner fillings of rubber-like material, are arranged and in which the twisted conductors are surrounded by a jacket provided with a reinforcement braid and a wrapping applied with a counter-lay, has been developed (U.S. Pat. No. 3,699,238).

For the mechanical design of control cables with layer-wise twisted insulated conductors, it is further known to arrange, in the corners between the conductors, a sliding agent in powder form as well as dust-tight release layers between the individual twisting layers (Swiss Pat. No. 389,047) or to provide, with the same twist direction in all twisting layers, for each twisting layer, a tape wrapping, the pitch direction of which is opposite to the twist direction of the twisting layers (DE-AS No. 14 65 777).

Starting out with a multiconductor flexible electric cable of the type described in U.S. Pat. No. 3,699,238, it is an object of the present invention to improve by design measures the control of the internal stresses occurring in winding and unwinding on or from a drum, without thereby affecting the flexibility of the cable adversely.

SUMMARY OF THE INVENTION

For solving this problem, in accordance with the present invention, in the outer region of the cable core between adjacent insulated conductors, support elements of plastic are symmetrically distributed over the circumference, resting laterally against adjacent insulated conductors; the spinning (wrapping) of the core is built-up of high-tensile strength elements of textile, plastic or glass fibers; and the core wrapping and the support elements are connected to each other via a thin plastic layer applied to the twisted assembly, adhesively or by cementing.

In such a design of the cable, the support elements are the tension elements which form a flexible guiding corset for the insulated conductors which does not affect the mobility of the cable as a whole adversely. The pressure which is taken up first by the support elements, which have a stiffness as low as possible, is conducted off to the tensile elements which hold the support elements in their position via tensile forces.

These support elements used in accordance with the present invention may also be corner fillings which consist of a thermo-elastic or rubber-elastic material with a Shore-A hardness of more than 70. This applies primarily for cables with 3 or 4 twisted insulated conductors. As the support element, however, a star-shaped strand of rubber-elastic material in the center of the three-or-four insulated conductor cables, the arms of which form chambers for receiving the conductors, can also be considered.

In the case of control cables with conductors twisted in layers, it is advisable to arrange the support elements in the outer layer as dummy conductors; the latter consist of a thermo-elastic or rubber-elastic material with a Shore-A hardness of more than 70. Advantageously, these support elements have a rectangular or slightly trapezoidal cross section. Similar support elements can be provided with a wrapping of high tensile strength elements which are applied with a lay opposite to the twisting layer; these elements are joined to the support elements of the respective twisting layer with adhesion via a thin adhesive layer or with a cemented layer.

In a cable designed in accordance with the present invention, the adhesive or cemented bond of the tensile elements to the support elements is advantageously carried out in such a manner that an adhesive, particularly a fusion adhesive or an adhesion promoting agent is used which is activated during the vulcanization of the jacket applied to the core of the cable. Such an adhesive can be applied to the core wrapping in the form of a thin layer of plastic if the wrapping has a coverage of at most 70 percent. However, the thin plastic layer can also be arranged under the core wrapping if provision is made, by coating the insulated conductors, twisted to form the cable core, with a release agent (powder, wax) so that no adhesive or cemented joint occurs between the insulated conductors and the core wrapping.

DETAILED DESCRIPTION

Figure 1:
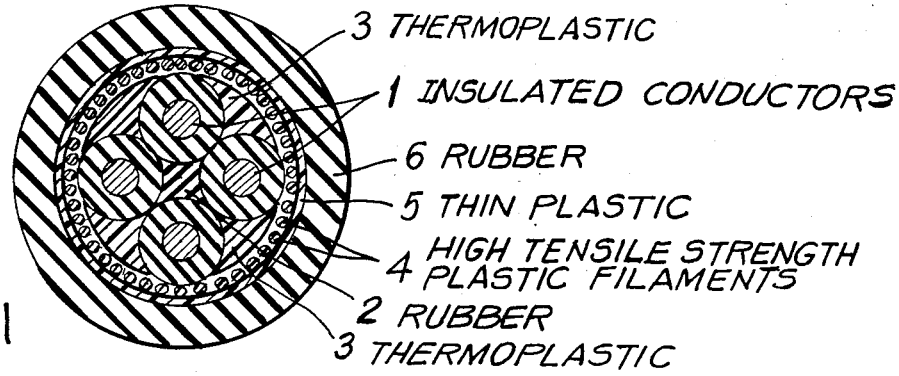
FIG. 1 is a cross section through a four conductor power cable according to the present invention.

FIG. 1 shows a four conductor power cable, in which the four insulated conductors 1 are twisted about a core 2 and in which support elements 3 of a thermoplastic material such as cross-linked polyethylene are arranged in the corner spaces between the insulated conductors. On this twisted assembly, a wrapping 4 of high tensile strength platic filament is applied, the direction of lay of which is opposite the twist direction of the twisted assembly. There is applied over the wrapping 4 a thin plastic layer 5 which is activated during the application and vulcanization of the outer jacket 6 in such a manner that a cemented or adhesive bond results between the support elements and the wrapping 4. The thin plastic layer 5 can consist, for instance, of a cross-linkable ethylene-propylene-terpolymer and can be cross-linked together with the outer jacket 6. In the application of the outer jacket, the thin layer 5 is pressed through the gaps of the wrapping 4 against the outer surface of the support elements 3. During the vulcanization process of the outer jacket 6, molecular bonds between the platic layer and the support elements 3 are obtained at the same time.

Figure 2:
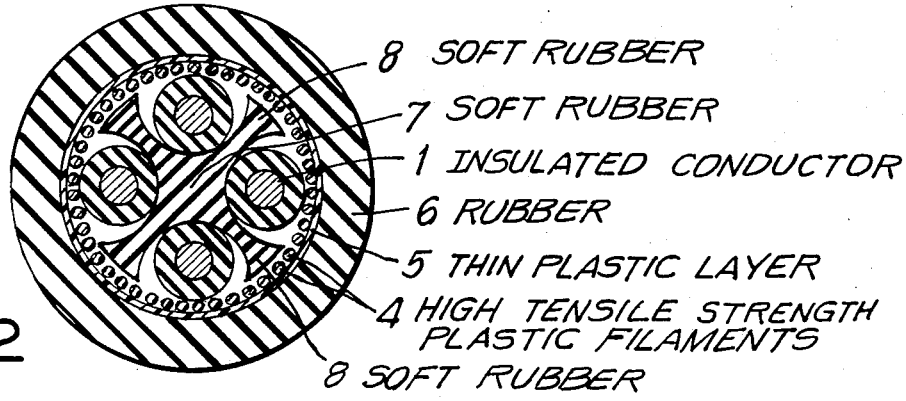
FIG. 2 is a similar view of an embodiment with support elements in the form of a support cross.

In the embodiment of FIG. 2, the support elements 8 arranged in corner spaces of the insulated conductors 1 are part of a support cross 7 which is arranged at the center of the cable. A relatively soft rubber mixture with a Shore-A hardness of 50 to 60 is used for the support cross 7. The wrapping 4, the thin plastic layer 5 and the outer jacket 6 are designed in the same manner as in the embodiment of FIG. 1. In order to prevent sticking of the thin plastic layer 4 to the surfaces of the insulated conductors 1, insulated conductors 1 may be coated with a lubricant.

Figure 3:
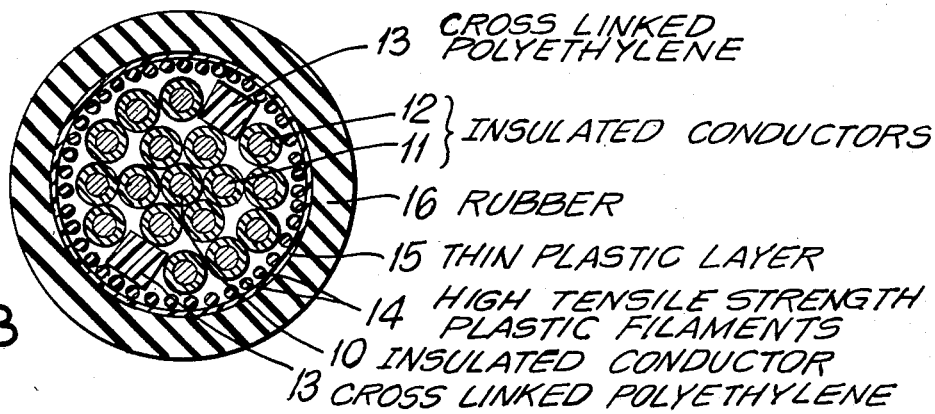
FIG. 3 is a cross section through a multiconductor cable according to the present invention.

In the embodiment of FIG. 3, a multiconductor control cable is involved where several insulated conductors 11 are twisted in a first layer about the central support member 10 and a second twisted layer of the insulated conductors 12 is provided. In the outer twisted layer, two support elements 13 with rectangular cross section are arranged symmetrically distributed over the circumference. These are dummy conductors of cross-linked or cross-linkable polyethylene. The insulated conductors 11 and 12, on the other hand, have rubber insulation. On the twisted assembly, a wrapping 14 of high tensile strength plastic filaments is arranged with a lay opposite to the twisting direction of a second twisting layer; it, in turn, is surrounded by a thin layer with an adhesion promoting property and is connected through the wrapping, which is applied with about 60 to 65 percent coverage, to the support elements 13. A connection with the insulated conductors 12 of the outer twist layer is prevented either by appropriate choice of material or by using a lubricating agent film which acts at the same time as a release layer.

Figure 4:
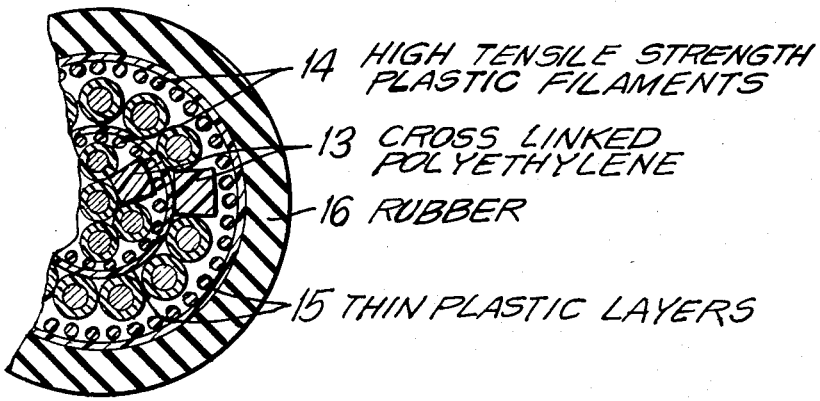
FIG. 4 is a cross section through a multiconductor cable according to the present invention, which cable has a two layer construction.

In the embodiment of FIG. 4, support elements 13 are also arranged in the inner twist layer. In this case a wrapping 14 of high tensile strength elements as well as the thin adhesion promoting layer 15 is also provided between the two layers of conductors.

What is claimed is:

1. In a multiconductor flexible electric cable, including three or four insulated conductors twisted to form a cable core surrounded by a core wrapping applied with a lay opposite that of the twisted insulated conductors, and a jacket of rubber-elastic material over the core wrapping, the improvement comprising:

(a) support elements consisting of corner filling of a thermo-elastic or rubber-elastic material with a Shore-A hardness of more than 70 disposed in the outer region of the cable core, symmetrically distributed over its circumference, resting laterally against the mutually adjacent insulated conductors,;

(b) the core wrapping being built-up of high tension strength elements of textile, plastic or glass fibres or of steel strands; and (c) a thin plastic layer applied to the cable core for attaching the core wrapping to the support elements by adhesion or cementing.

2. A cable according to claim 1, wherein the core wrapping has a coverage of at most 70 percent and wherein said thin plastic layer is applied over the core wrapping and consists of an adhesive or adhesion promoting agent which is activated during the vulcanization of the jacket.

3. A cable according to claim 1, wherein a thin the thin plastic layer is disposed under the core wrapping and consists of a fusion adhesive activated during the vulcanizaiton of the jacket, and wherein the conductors twisted to form the cable core are coated with a release agent.

4. In a multiconductor flexible electric cable, including insulated conductors twisted in at least an inner and an outer layer, to form a cable core surrounded by a core wrapping applied with a layer opposite that of the twisted insulated conductors, and a jacket of rubber-elastic material over the core wrapping, the improvement comprising:

(a) support elements consisting of a thermo-elastic or rubber-elastic material with a Shore-A hardness of more than 70 in the form of running conductors disposed in the outer layer of conductors, symmetrically distributed over its circumference, resting laterally against the mutually adjacent insulated conductors;

(b) the core wrapping being built-up of high tension strength elements of textile, plastic or glass fibres or of steel strands; and (c) a thin plastic layer applied to the cable core for attaching the core wrapping to support elements by adhesion or cementing.

5. A cable according to claim 4, wherein said support elements have a rectangular or slightly trapezoidal cross section.

6. A cable according to claim 5, wherein the core wrapping has a coverage of at most 70 percent and wherein said thin plastic layer is applied over the core wrapping and consists of an adhesive or adhesion promoting agent which is activated during the vulcanization of the jacket.

7. A cable according to claim 5, wherein the thin plastic layer is disposed under the core wrapping and consists of a fusion adhesive activated during the vulcanization of the jacket, and wherein the conductors twisted to form the cable core are coated with a release agent.

8. A cable according to claim 4, wherein the core wrapping has a coverage of at most 70 percent and wherein said thin plastic layer is applied over the core wrapping and consists of an adhesive or adhesion promoting agent which is activated during the vulcanization of the jacket.

9. A cable according to claim 4, wherein the thin plastic layer is disposed under the core wrapping and consists of a fusion adhesive activated during the vulcanization of the jacket, and wherein the conductors twisted to form the cable core are coated with a release agent.

10. A cable according to claim 4, wherein the core wrapping has a coverage of at most 70 percent and wherein said thin plastic layer is applied over the core wrapping and consists of an adhesive or adhesion promoting agent which is activated during the vulcanization of the jacket.

11. A cable according to claim 4, wherein the thin plastic layer is disposed under the core wrapping and consists of a fusion adhesive activated during the vulcanization of the jacket, and wherein the conductors twisted to form the cable core are coated with a release agent.

12. A cable according to claim 4, wherein the core wrapping has a coverage of at most 70 percent and wherein a thin plastic layer is applied over the core wrapping and consists of an adhesive or adhesion promoting agent which is activated during the vulcanization of the jacket.

13. A cable according to claim 4, wherein the thin plastic layer is disposed under the core wrapping and consists of a fusion adhesive activated during the vulcanization of the jacket, and wherein the conductors twisted to form the cable core are coated with a release agent.

14. In a multiconductor flexible electric cable, including three or four insulated conductors twisted to form a cable core surrounded by a core wrapping applied with a layer opposite that of the twisted insulated conductors, and a jacket of rubber-elastic material over the core wrapping, the improvement comprising:

(a) support elements forming a star-shaped strand of rubber-elastic material, the arms of which form chambers for receiving the insulated conductors extending to the outer region of the cable core, symmetrically distributed over its circumference, resting laterally against the mutually adjacent insulated conductors;

(b) the core wrapping being built-up of high tension strength elements of textile, plastic or glass fibres or of steel strands; and (c) a thin plastic layer applied to the cable core for attaching the core wrapping to the support elements by adhesion or cementing.

15. A cable according to claim 14, wherein the core wrapping has a coverage of at most 70 percent and wherein said thin plastic layer is applied over the core wrapping and consists of an adhesive or adhesion promoting agent which is activated during the vulcanization of the jacket.

16. A cable according to claim 14, wherein the thin plastic layer is disposed under the core wrapping and consists of a fusion adhesive activated during the vulcanization of the jacket, and wherein the conductors twisted to form the cable core are coated with a release agent.

17. A cable according to claim 14, wherein the core wrapping has a coverage of at most 70 percent and wherein said thin plastic layer is applied over the core wrapping and consists of an adhesive or adhesion promoting agent which is activated during the vulcanization of the jacket.

18. A cable according to claim 14, wherein the thin plastic layer is disposed under the core wrapping and consists of a fusion adhesive activated during the vulcanization of the jacket, and wherein the conductors twisted to form the cable core are coated with a release agent.

19. A cable according to claim 5, wherein similar support elements are disposed in the inner twist layer or layers and wherein said innner and outer layers are each provided with a wrapping of high tensile strength elements with a lay opposite to the respective twisted layer wrapped thereby and each wrapping connected to the support elements of its respective twisted layer with strong adhesion via an adhesion or cemented layer.

20. A cable according to claim 4, wherein similar support elements are disposed in the inner twist layer or layers and wherein said inner and outer layers are each provided with a wrapping of high tensile strength elements with a lay opposite to the respective twisted layer wrapped thereby and each wrapping connected to the support elements of its respective twisted layer with strong adhesion via an adhesion or cemented layer.

* * * * *